United States Patent [19]

Tao et al.

[11] 4,437,917

[45] Mar. 20, 1984

[54] CONTROL OF BULK IN AIR LAID FIBROUS WEBS

[75] Inventors: Thomas M. Tao, Neenah, Wis.
William C. Bean, Larsen, Wis.

[73] Assignee: James River/Dixie-Northern, Inc., Norwalk, Conn.

[21] Appl. No.: 475,617

[22] Filed: Mar. 15, 1983

Related U.S. Application Data

[63] Continuation of Ser. No. 219,613, Dec. 24, 1980, abandoned.

[51] Int. Cl.[3] ..... B32B 31/00

[52] U.S. Cl. ..... 156/296; 19/296; 156/360; 264/121

[58] Field of Search ..... 156/296, 62.2, 67.4, 156/183, 359, 360, 322, 290; 264/121, 282, 128, 283, 518, 115; 425/81.1, 80.1, 82.1, 83.1; 19/30, 305, 296, 161.1, 300

[56] References Cited

U.S. PATENT DOCUMENTS 2,493,194 1/1950 Heino ..... 425/83.1

3,821,068 6/1974 Shaw ..... 156/183

4,093,765 6/1978 Schmidt ..... 128/280 P

*Primary Examiner*—Michael W. Ball

*Attorney, Agent, or Firm*—Finnegan, Henderson, Farrabow, Garrett, et al.

[57] ABSTRACT

A method of increasing the caliper and bulk of air laid dry fibrous webs, particularly such webs intended for use as napkin, tissue, and absorbent paper towel products by partially drying the loose formed fibrous webs to a degree of dryness of less than 4% prior to consolidation. In the preferred embodiment uniformity of the product web caliper in the machine direction is obtained by measuring the caliper downstream of the bond curing drier and before take-up on the parent roll, output signals therefrom being transmitted to the drier for adjustment of one or more of the drier parameters. Uniformity of caliper in the cross machine direction can be optimized by providing multisectional driers in the cross machine direction, a series of output signals from the caliper sensing means being transmitted to the respective drier sections for individual adjustment of the drier parameters.

12 Claims, 4 Drawing Figures

CONTROL OF BULK IN AIR LAID FIBROUS WEBS

This is a continuation of application Ser. No. 219,613 filed Dec. 24, 1980, now abandoned.

FIELD OF INVENTION

This invention relates to the manufacture of dry laid fibrous webs of high bulk whose end use is for towel, tissue, napkin, filter, and absorbent substrates and the like. Specifically, the invention relates to a method for increasing the bulk of said webs by proper control of the web fiber moisture content upstream of web consolidation.

BACKGROUND OF INVENTION

Air laid (or dry laid) webs are presently produced by dispensing dry loose fibers, generally less than ¼ inch long, from one or more distributors onto a moving foraminous forming wire to obtain a loose web having little strength or integrity. To give some strength to the loose web, the web is then consolidated between two compaction rolls or belts. The strength thus imparted enables transfer of the web from the forming wire to a foraminous carrier wire, which carries the web through subsequent bonding and drying operations. After drying, the web is wound-up on a parent roll. One advantage of dry-laid technology over more conventional wet laid processing is the increase in the bulk of the product web, which decreases the amount of fiber required per unit volume while improving softness. Generally, then, it is desirable to increase bulk if other required properties can be at least retained. In some end use applications improved bulk and softness are more important parameters than other properties, which can be reduced appropriately. Bulk as used herein is defined as the four ply caliper of the product web by a standard caliper gauge such as the TMI micronmeter divided by its basis weight increased fourfold.

Loose fibers used in dry-laid processes are typically prepared by defiberizing pulp rolls, laps or bales in a hammermill or its equivalent, said fibers then being transported to the distributor pneumatically. During defiberizing, the fibers are dried unintentionally to a moisture content of less than 3% by weight, generally less than 2%. At this moisture level, the fibers transported to the distributor are subject to electrostatic charge forces which interfere with proper fiber transportation and web formation in that they clump together or adhere to machine surfaces, and are particularly dangerous because of the potential for explosion. To overcome this condition, existing practice is to enclose the forming section of the web manufacturing process within a room of regulated temperature and humidity. With the room temperature typically at 70° F. and at a relative humidity of about 70%, sufficient driving force exists for said fibers to absorb moisture from the humidified air. Through the length of the forming wire, and during the residence time of said fibers in the distributor and on the wire, usually between 4 and 15 seconds, the fibers will pick up 2 to 5% additional moisture before reaching the aforesaid consolidation rolls. Applicants have found that this increase in fiber moisture content deleteriously affects the bulk of the final web product. Applicants have found further that variations in bulk of the product web in the cross machine direction are attributable in part to the non-linearity of moisture content profiles transverse of the forming wire prior to consolidation.

SUMMARY OF INVENTION

It is an object of this invention to provide a method of increasing the bulk of product webs formed by dry laid technology.

A further object of this invention is to provide an automated method of increasing bulk of dry laid webs.

Another object of this invention is to provide a method for obtaining dry laid webs of uniform caliper in the cross machine direction.

A collateral object of this invention is to disclose a system to carry out the above stated methods.

These and other objects of the invention will be more clearly understood upon an inspection of the drawings, and upon a reading of the detailed description of the invention, a summary of which follows.

Applicants have found that there is a correlation between moisture content of a dry laid loose fibrous web before consolidation and the caliper of the finished product web. As moisture content of the web decreases, caliper, or, for the same basis weight product, bulk of the product web increases. However, this correlation does not apply to webs previously compacted. The invention then relates to a method of increasing bulk by partially drying the non-compacted web before consolidation preferably by means of a through air drier or a microwave drier which reduces moisture content of the web at this point in the process to less than 4% by weight. It has been found that the preferred drying temperature is about 180° to 260° F., while the air flow rate for commercial equipment would be between 200 and 400 fpm. at operating temperature and essentially atmospheric pressure.

This invention can be used to control the caliper of the product web by scanning the product web in the cross machine direction with a caliper measurement device, the output signals therefrom being transmitted to the drier to control a selected variable. In the preferred embodiment, the drier is comprised of a plurality of sections extending in the cross machine direction, each section receiving an output signal from the caliper sensor corresponding to the respective web section. In his way caliper in the cross machine direction can be controlled uniformly.

DETAILED DESCRIPTION OF INVENTION

Figure 1:
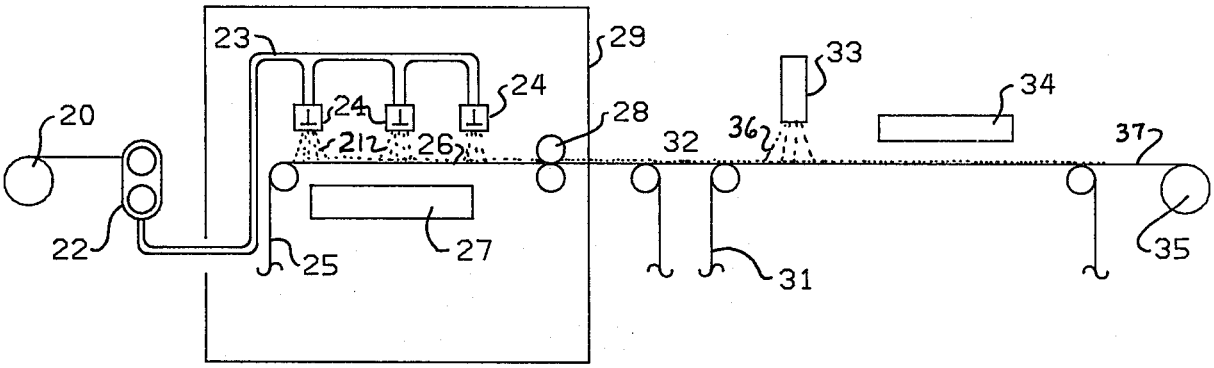
FIG. 1 PRIOR ART
FIG. 1 is a flow diagram of a conventional dry laid web forming process.

FIG. 1 shows the overall sequence of existing operations used in the production of fibrous webs by dry laid technology. Pulp rolls, laps or bales, here pulp roll 20, are fed into a defiberizer, here hammermill 22, and are comminuted to loose fibers 21 of generally less than ¼ inch in length. The roll 20 typically has a moisture content of between about 5 to 12% by weight, depending upon the storage conditions. Mechanical energy from the hammermill 22 is dissipated in the form of heat, the temperature of the outlet fibers, which are transported pneumatically through transfer conduit 23 to one or mre distributors 24, being raised thereby to about between 130° and 200° F. At the conditions in the hammermill and the transfer conduit 23, the moisture content of the fibers is reduced to less than 3%, typically below 2%, by weight.

The loose fibers 21 from the distributors 24 are then dispensed onto an endless moving foraminous forming wire 25, a loose web 26 being formed thereby, said fibers being carried by a stream of ambient air drawn through the distributors 24 to a suction box 27 beneath said forming wire 25. Because little moisture is present, the individual fibers comprising the loose web 26 are not susceptible to inter-fiber hydrogen bonding as in the much older wet laid process. Hence, the loose web 26 does not have significant strength at this stage in the process. For this reason the loose web 26 is compacted between consolidation rolls 28, which impart to the web sufficient strength to effect a transfer from the forming wire 25 to a carrier wire 31.

The carrier wire 31 carries the compacted web 32 through the remaining bonding and drying operations. As mentioned above, dry laid webs are inherently incapable of hydrogen bonding, so that a binding agent material 36 is applied to the web 32 at bond station 33, the binding agent then being dried and cured in drier 34, here a through air drier of conventional design. The dried web 37 is then wound-up on a parent roll 35, completing the process steps for making dry laid webs as now represented by the prior art. Webs produced in this way are superior to wet laid webs in that the caliper of the product web is greater by about 40 to 120% and are perceptibly softer to the touch. For a given basis weight web, then, the bulk of the web is greater, bulk being defined as the 4 ply caliper in thousandths of inches as measured at a load of 26.6 gms./cm.$^2$ divided by basis weight increased fourfold in pounds per ream of 3,000 sq. ft. Conversely, the amount of fiber required to make a web of a given caliper is less as bulk increases. For this reason, it is highly desirable to obtain webs of greater caliper, provided, however, that other properties can be retained or maintained within commercially feasible limits. Furthermore, as bulk increases, greater softness is typically perceived.

In performing the above described process, certain other factors are also germaine to an understanding of the present invention. As mentioned above loose fibers 21, prior to their introduction into the distributor 24, have a moisture content of less than about 3%. To form a properly laid web, however, it is desirable that the moisture content of the fibers constituting web 26 just below the distributors 24 be greater than 3%, preferably greater than 4%, by weight, the additional moisture offsetting the undesirable electrostatic charges that arise with very dry fibers. To eliminate these charges, it is now a practice to enclose the forming section within a room, designated by numeral 29 in FIG. 1, the room air therein having a constant temperature and humidity environment. The temperature is generally between 65° and 85° F., while the relative humidity must be high enough to ensure that there exists a driving force for rapid moisture transfer to the fibers within distributors 24 and comprising the loose web 26 from the air drawn into the suction box 27. This transfer must take place essentially along the length of the forming wire 25, which may be fifty to two hundred feet long, and within the time the web remains on said wire 25. For a 100 foot forming wire, and with machine speeds of 400 to 1,500 fpm., the residence time is only 4 to 15 seconds, thereby necessitating a large driving force. Air relative humidity is generally maintained at about 70%, but may be set within a range of from about 50% to about 85% depending on such factors as loose fiber moisture content, forming wire speed, air velocity through the web, basis weight of the loose web 26, and fiber-moisture equilibrium properties. At the end of the wire 25, and before consolidation, the web 26 generally will have a moisture content of about 4 to 6% by weight.

Figure 2:
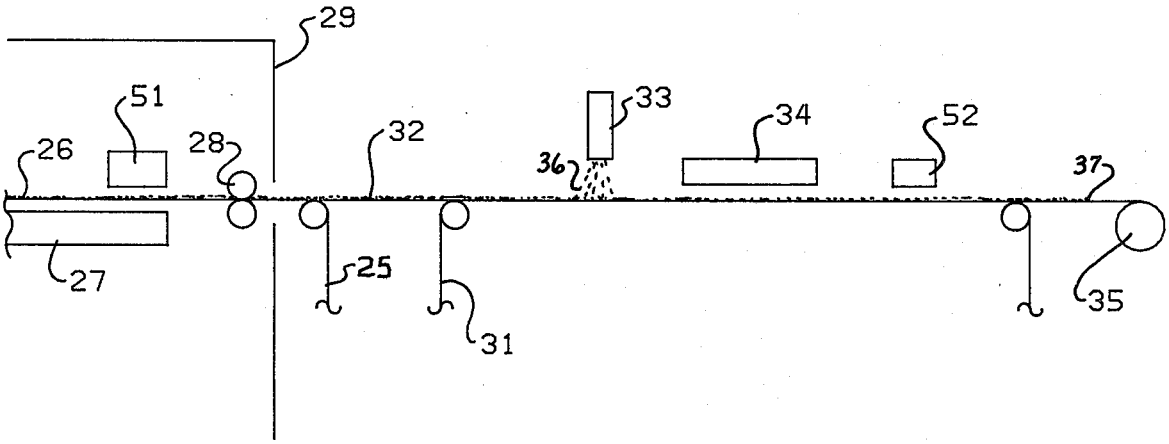
FIG. 2 shows a pertinent portion of the process of FIG. 1 with the features of the present invention contained therein.

Applicants have found that a reduction in the moisture content of the web 26 before consolidation in rolls 28 results in an increase of the caliper of the final product 35. FIG. 2 shows the pertinent portion of the apparatus of FIG. 1 together with the additional elements which are the subject of this invention. Like elements in FIGS. 1 and 2 have been similarly numbered. To effect a decrease in the moisture of the web 26 before consolidation, applicants have added a drier 51. The drier is preferably a through air drier or microwave drier. By this device, the web moisture content can be reduced from about 4 to 6% by weight to about 2 to 4% by weight, resulting in a bulk improvement of 10 to 15%.

Air to the drier 51, regulated by temperature and flow control means (not shown), is heated to between 150° to 350° F., preferably to between 180° and 260° F. At these conditions, the relative humidity of the air stream is very low, and a high driving force for drying is obtained. Hence, drier residence time of the web can be low, generally no more than 0.1 to 1 second. For a wire moving at 900 fpm, the length of the drier in the machine direction is only 1.5 to 15 feet, although the length is not critical. Air flow rates through the web can be regulated by the vacuum suction applied in the vacuum box 27, and should be consistent with the amount and rate of heat transferred to the web. Further, the air exhaust temperature should be compatible with the exhaust system design, particular with respect to explosion suppression equipment contained therein. Typically, the air flow in commercial installations would be about 200 to 400 fpm. at operating temperature and essentially atmospheric pressure.

Figure 3:
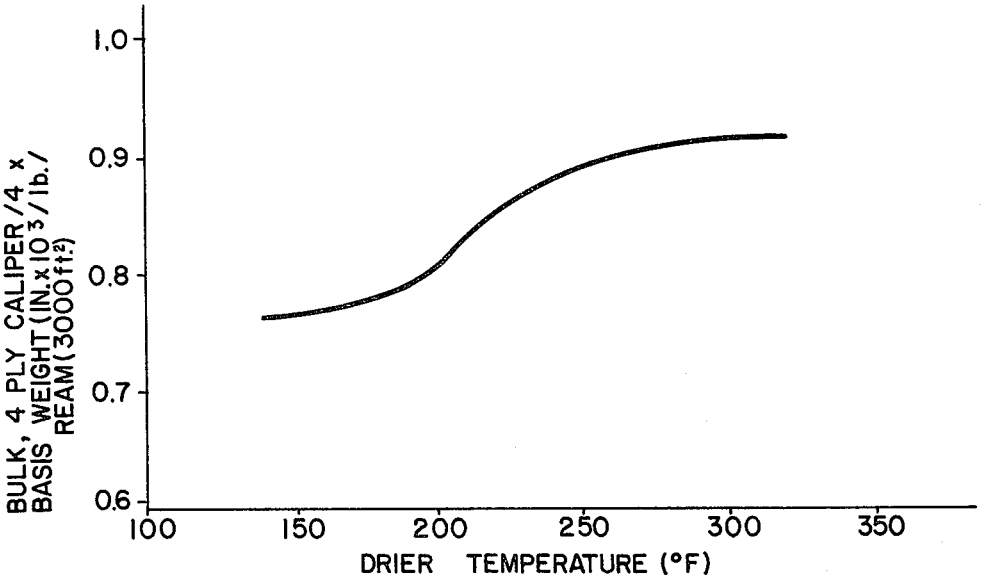
FIG. 3 is a graph illustrating the effect of drying upstream of the consolidation rolls on the bulk of a product web.

FIG. 3 graphically illustrates the increase in bulk that is obtained with this invention. Bulk is plotted on the coordinate for unbonded webs, while drier temperature appears along the abscissa. It will be noted that the bulk increase is asymptotic at low air and at higher air inlet temperatures, with the greatest rate of change in bulk occurring in the preferred temperature range of 180° to 260° F. Bulk for unbonded webs, as opposed to bonded webs, was measured for convenience, the respective bulk measurements for each being linearly related.

Figure 4:
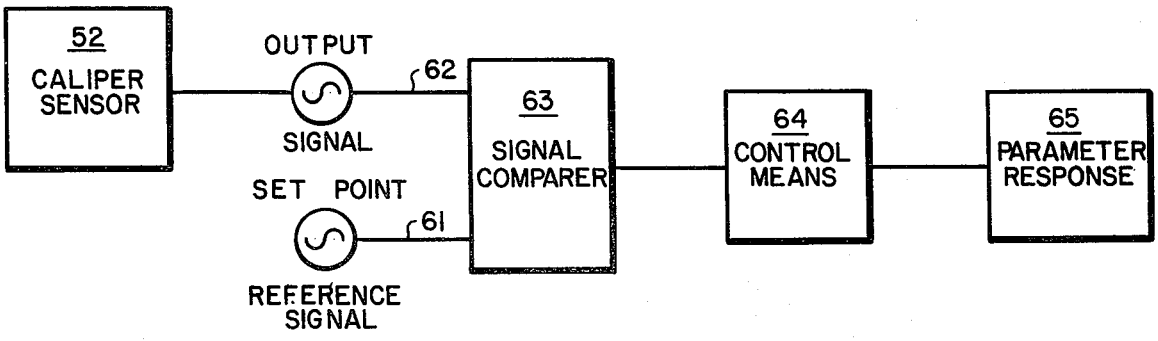
FIG. 4 is a schematic diagram of the control loop used in relation with the present invention.

As will be readily understood, the use of the drier to regulate bulk of final web products has significant application to the automatic control of product caliper. Caliper of the web 37 before the parent roll can be measured by an on-line unit 52 such as that marketed by Autech, Inc. under the trade name Dimension Gauge, Model 1000. This machine scans the moving web in the cross machine direction and electro-optically determines the web caliper. As indicated in the control logic diagram, FIG. 4, the output signal 62 transmitted from the caliper indicator 52 is compared with the set point reference signal 61, and in light of this comparison identified by box 62 in the logic diagram, adjusts the air flow damper or fuel flow control valve in accordance with box 64.

Of course dual control by means of a split range control device can also be used. The change of the damper or valve position then adjusts the air flow or air temperature to the drier 51, respectively, as indicated in box 65. The caliper of the fibrous web 32 is thus modified, said modification ultimately appearing in the dried web 37. Of course, the increase in web caliper obtained downstream of the consolidation rolls 28 will not be equal to the increase at the parent roll inasmuch as further processing, e.g., bonding and drying, is required. However, the effect obtained at the consolidation rolls is retained in the parent roll, and increases the bulk of the final web product key about between 10 to 15%. Web moisture content before and after the drier 51 can also be measured, for example, by Quadra-Beam IR reflectance gauges manufactured by Moisture Systems Corporation, to provide additional useful information to the operator.

The above described method of caliper control may also be used to reduce variations in cross machine web caliper. In commercial units, the width of the web is about 10 to 30 feet. Neither uniform distribution of the fibers onto the wire, nor uniform humid air flow through the web to the suction box is always achieved satisfactorily. Maldistrbution occurs because of transverse pressure gradients within the suction box 27, which gradients cannot be adequately eliminated by baffle and damper means. Hence, the web 32 may have a non-uniform caliper profile in the cross machine direction because web sections proximate to the wire edge typically pick up greater moisture from the humid air in room 29 than the interior sections. These variations in caliper would then appear in web 37, the end product.

This problem can be alleviated to a considerable extent by providing multisectional driers 51 across the lateral web surface. Three sections are considered adequate, but more can be used if greater precision is desired. Output signals transmitted from the caliper monitor 52 and corresponding to the individual lateral sections of the web would thus regulate the temperature and/or air flow parameters for each of the drier 51 sections. That is, temperature and/or air flow parameters for each drier can be varied to achieve an essentially uniform web caliper in the cross-machine direction.

Predried, compacted, unbonded webs of the present invention were compared to conventional compacted, unbonded webs, and were found to have comparable tensile strengths despite the increase in caliper. Hence, webs 26 dried within device 51 can be transferred after consolidation in rolls 28 without difficulty. The method can also be used with either bronze or synthetic forming wires, the bulk increase being realized in each instance. Furthermore, the method does not contribute significantly to additional losses of fiber fines, and such fines which do accumulate can be blended with the defiberized loose fibers. No significant adverse effects were found on caliper, water holding capacity or tensile strength at fine addition rates of about 11% by weight of the total fibers.

The method described herein has other collateral advantages. Because the web 32 is more porous (greater bulk), the efficiency of the drier 34 is greater. Thus the drier 34 air temperature can be decreased, or less air supplied thereto. Hence, while the overall heat balance would show that more energy is necessary, this is not as great as would be expected. Secondly, binding agent can be expected to penetrate the more porous web of this invention more easily so that higher emulsion concentrations might be justified. This, too, could decrease the heat load on the drier 34.

EXAMPLE I

A series of six runs were made on a pilot paper making machine. Loose Ontario softwood pulp fibers were dispensed onto a bronze forming wire moving at 200 fpm. The forming room temperature was 85° F., and the relative humidity 55%. The first two runs did not use the drier 51 to remove moisture from the unbonded web, while runs 3 to 6 employed the drier at two different temperature levels. In runs 2, 4 and 4, 10.8% of the web consisted of recycled fines. In each run latex binding agent solids contributed to 17% of the basis weight of the finished web. Reel speed in each run was between 215 and 233 fpm. The results are summarized in Table I.

TABLE I

| Run | Drier Inlet Air Temperature (°F.) | % Fines | Basis Weight (lbs./rm.) | Caliper, 4-Ply (inches × $10^3$) | Bulk | Water Holding Capacity Ratio | Cured CD Wet Tensile (gms./3") |
|---|---|---|---|---|---|---|---|
| 1 | Not Used | None | 43.1 | 146 | 0.85 | 12.4 | 1591 |
| 2 | Not Used | 10.8 | 44.9 | 150.0 | 0.84 | 12.3 | 1605 |
| 3 | 240 | None | 39.6 | 169.3 | 1.07 | 16.6 | 1311 |
| 4 | 240 | 10.8 | 42.1 | 171.8 | 1.02 | 15.8 | 1334 |
| 5 | 200 | None | 39.6 | 160.7 | 1.01 | 15.5 | N/A |
| 6 | 200 | 10.8 | 42.0 | 164.8 | 0.98 | 15.3 | N/A |

EXAMPLE II

A second series of five runs was conducted on a synthetic forming wire, No. 5,710, of polyester and obtained from the Appleton Wire Company. Air temperature in the forming room was 85° F. Relative humidity was 55%. Again, 12% latex solids were added to the unbonded web. The consolidation rolls were heated to about 195° F. in each case, and a pressure of 45 lbs. per linear inch applied to the web. In each run wire speed was about 230 fpm. Table II summarizes these runs.

TABLE II

| Run | Drier Inlet Air Temperature(°F.) | % Fines | Basis Weight (lbs./rm.) | Caliper, 4-Ply (inches × $10^3$) | Bulk | Water Holding Capacity Ratio | Cured CD Wet Tensile (gms./3") |
|---|---|---|---|---|---|---|---|
| 1 | Not Used | None | 41.5 | 161.4 | 0.97 | 14.7 | 1377 |
| 2 | Not Used | 10.8 | 42.9 | 165.2 | 0.96 | 14.6 | 1296 |
| 3 | 240 | None | 38.8 | 186.8 | 1.20 | 17.7 | 1026 |

TABLE II-continued

| Run | Drier Inlet Air Temperature(°F.) | % Fines | Basis Weight (lbs./rm.) | Caliper, 4-Ply (inches × $10^3$) | Bulk | Water Holding Capacity Ratio | Cured CD Wet Tensile (gms./3") |
|---|---|---|---|---|---|---|---|
| 4 | 240 | 10.8 | 43.2 | 192.5 | 1.11 | 18.4 | 1035 |
| 5 | 200 | None | 38.6 | 179.3 | 1.16 | 17.5 | 1127 |

The above description is intended to be exemplary of the invention only, the limits and constraints thereof being defined by the claims appearing below.

We claim:

1. A method of increasing bulk of dry-formed fibrous webs during their manufacture, comprising the steps of:
   forming a loose web of fibers dispersed on a forming wire in a zone under temperature and humidity conditions that cause the loose web to have a moisture content of more than 4% by weight;
   partially drying the loose web to reduce the moisture content of the web to less than 4% by weight; and
   subjecting the loose, partially dried web to compaction or consolidation to impart some strength to the web.

2. The method according to claim 1 also including the step of applying a binding agent material to the compacted or consolidated web.

3. The method of claim 1 wherein the drying is accomplished with a through air drier, the drier air temperature thereto being between 150° to 350° F.

4. The method of claim 3 wherein the preferred drier air temperature is between 180° and 260° F.

5. The method of claim 4 wherein the drier air flow rate is between 200 and 400 fpm. at operating temperature and essentially atmospheric pressure.

6. The method of claims 1 or 4 wherein the drier has a plurality of sections, each operating independently, in the cross-machine direction.

7. A method for controlling the caliper of dry-laid fibrous webs containing a cured bonding agent, the method comprising the steps of:
   air laying loose fibers on a forming wire under temperature and humidity conditions that cause the moisture content of the initially formed web to be greater than about 4% by weight;
   partially drying said web before consolidation thereof to a moisture content of less than about 4%;
   scanning the bonded, cured web in the cross-machine direction to ascertain web caliper with a caliper measurement sensor, output signals being obtained therefrom, and adjusting the degree of dryness before consolidation in response to said output signals; and
   subjecting the loose, partially dried web to compaction or consolidation to impart some strength to the web.

8. The method of claim 7 wherein the controlled variable is drier air temperature to the drier, the temperature being controlled between 150° and 350° F.

9. The method of claim 8 wherein the preferred operating temperature range is between 180° and 260° F.

10. The method of claim 8 wherein drier air flow rate is also a controlled variable, the controlled variables being subject to split range modulation.

11. The method of claim 7 wherein the controlled variable is drier air flow rate, the flow rate being controlled between 200 and 400 fpm. at operating temperature and essentially atmospheric pressure.

12. The method of claim 7, 8, 9, 11 and 10 wherein the drier is a multisectional design, each section thereof relating to a section of the web in the cross machine direction, each said corresponding section of the bonded, cured web being scanned by the caliper measurement sensor which provides output signals equal in number to the number of drier sections, the output signals therefrom being transmitted to the respective drier sections for adjustment of the controlled variable(s) whereby a uniform caliper profile of the final web product in the cross machine direction is achieved.

* * * * *